US007740524B2

(12) United States Patent
Ray, Jr.

(10) Patent No.: US 7,740,524 B2
(45) Date of Patent: Jun. 22, 2010

(54) DRYWALL CORNER SANDING TOOL

(76) Inventor: Charles T. Ray, Jr., 130 Lark La., Harvest, AL (US) 35749

( * ) Notice: Subject to any disclaimer, the term of this patent is extended or adjusted under 35 U.S.C. 154(b) by 32 days.

(21) Appl. No.: 12/008,443

(22) Filed: Jan. 11, 2008

(65) Prior Publication Data

US 2009/0181607 A1 Jul. 16, 2009

(51) Int. Cl.
*B24B 23/02* (2006.01)

(52) U.S. Cl. ..... 451/354; 451/359

(58) Field of Classification Search ..... 451/354, 451/359, 344, 557, 558, 28; 76/85
See application file for complete search history.

(56) References Cited

U.S. PATENT DOCUMENTS 6,659,852 B1 * 12/2003 Wettstein et al. ..... 451/557
6,991,529 B2 * 1/2006 Annis et al. ..... 451/557
7,275,981 B1 * 10/2007 Hurt et al. ..... 451/524

* cited by examiner

*Primary Examiner*—Robert Rose
(74) *Attorney, Agent, or Firm*—Mark Clodfelter

(57) ABSTRACT

A sanding tool for sanding drywall corner joints is provided. The tool has an elongated mounting plate with a swivel handle attached to one side, and to the other side is attached one or more circular sanding disk holders to which disks of sanding medium are removably attached to a flat face of the sanding disk holder. The sanding disk holders are rotatably mounted on short axles attached to the mounting plate, and are each configured having a relatively wide edge that frictionally engages a wall adjacent the wall being sanded. This causes the sanding disk holder to rotate, sanding the drywall joint with a rotary motion instead of a linear motion.

14 Claims, 3 Drawing Sheets

DRYWALL CORNER SANDING TOOL

FIELD OF THE INVENTION

This invention relates generally to drywall sanding tools, and particularly to a drywall sanding tool for sanding adjacent sides of corners.

BACKGROUND OF THE INVENTION

Installing drywall involves nailing or screwing sheets or panels of drywall, which is typically manufactured as either 4' by 8' or 5' by 12' sheets, adjacent to one another to studs along a wall. The factory edges of such drywall panels are beveled, typically for about 2-3 inches or so along the edge, so that drywall "mud" may be spread by a trowel into the beveled regions between two mounted panels, and drywall tape pressed into the mud so as to contiguously join the two panels. Such a joint may be 4" to 6" or so in width. A second coat of mud is then troweled over the tape, and after the mud dries, the mud-covered interface between the two panels is sanded smooth and flush so that there is no discernable break between the two panels. Where two panels meet at a corner of a room, or where a ceiling drywall panel meets a wall panel, a 90 degree corner joint is formed. Here, drywall tape is typically scored or otherwise creased longitudinally down the middle thereof so that it may be easily longitudinally bent 90 degrees and pressed into drywall mud forming a corner. As with other drywall joints, the mud of the corner joints must be sanded after it dries in order to present a smooth, aesthetically pleasing appearance of the corners. As noted, the beveled region of drywall filled with drywall mud may extend 2"-3" or so outward from the corner.

While sanding drywall mud of planar wall joints of drywall is relatively easy, sanding drywall mud in corners is relatively difficult. Dried drywall mud is relatively soft and easy to damage, which requires additional mud to be troweled into the damaged areas, and a wait time of typically 24 hours for the repair mud to dry. Such damage typically occurs when an edge of sandpaper, a sandpaper holder or sandpaper sponge contacts the adjacent mud joint of a corner while the sandpaper, sandpaper tool or sponge is being rubbed on the opposite mud joint corner, developing a groove or gouge in the wall of the corner not being sanded.

In order to address this problem, one potential solution is advanced by U.S. Pat. No. 6,325,708, to Miles, which teaches a V-shape plate that holds or supports sanding pads or sheets thereon. The V-shaped plates holding the sandpaper elements have sides disposed at 90 degrees to each other. One problem with this arrangement is that the angle of the two flat plates seldom accurately matches the angle of drywall corners, which are rarely accurately configured exactly 90 degrees to each other. Here, where one side of a corner is correctly sanded, the other side will be either excessively sanded or insufficiently sanded. As such, the device of Miles inadequately addresses the problem of sanding drywall corners.

Another proposed solution is drywall sanding sponge configured generally in square or rectangular blocks wherein edges thereof are beveled or tapered slightly so that a drywall technician may carefully sand by hand one side of the corner, and then sand by hand the other side of the corner. However, this is a laborious, tedious and time-consuming process, and is subject to damaging the drywall mud of a corner portion of a wall adjacent the wall joint being sanded. In addition, such a hand sanding process is very abrasive to skin of a drywall technician; it not being uncommon for hands of such an individual to be blistered and bleeding at the end of a day's work. Also, as noted, dried drywall mud is so soft that even a single sanding stroke where the edge of the sanding medium contacts the adjacent wall may cause a groove or gouge in the mud of the adjacent wall, which then requires repair. Also, sandpaper holders of the prior art may be bumped against the adjacent wall, creating a gouge in the drywall mud that requires repair.

In view of the foregoing, it is apparent that a need exists for a drywall sanding tool for sanding drywall mud in corners that is easy to use, that will not damage adjacent walls and is fast and efficient in its operation.

DETAILED DESCRIPTION OF THE DRAWINGS

Figure 1:
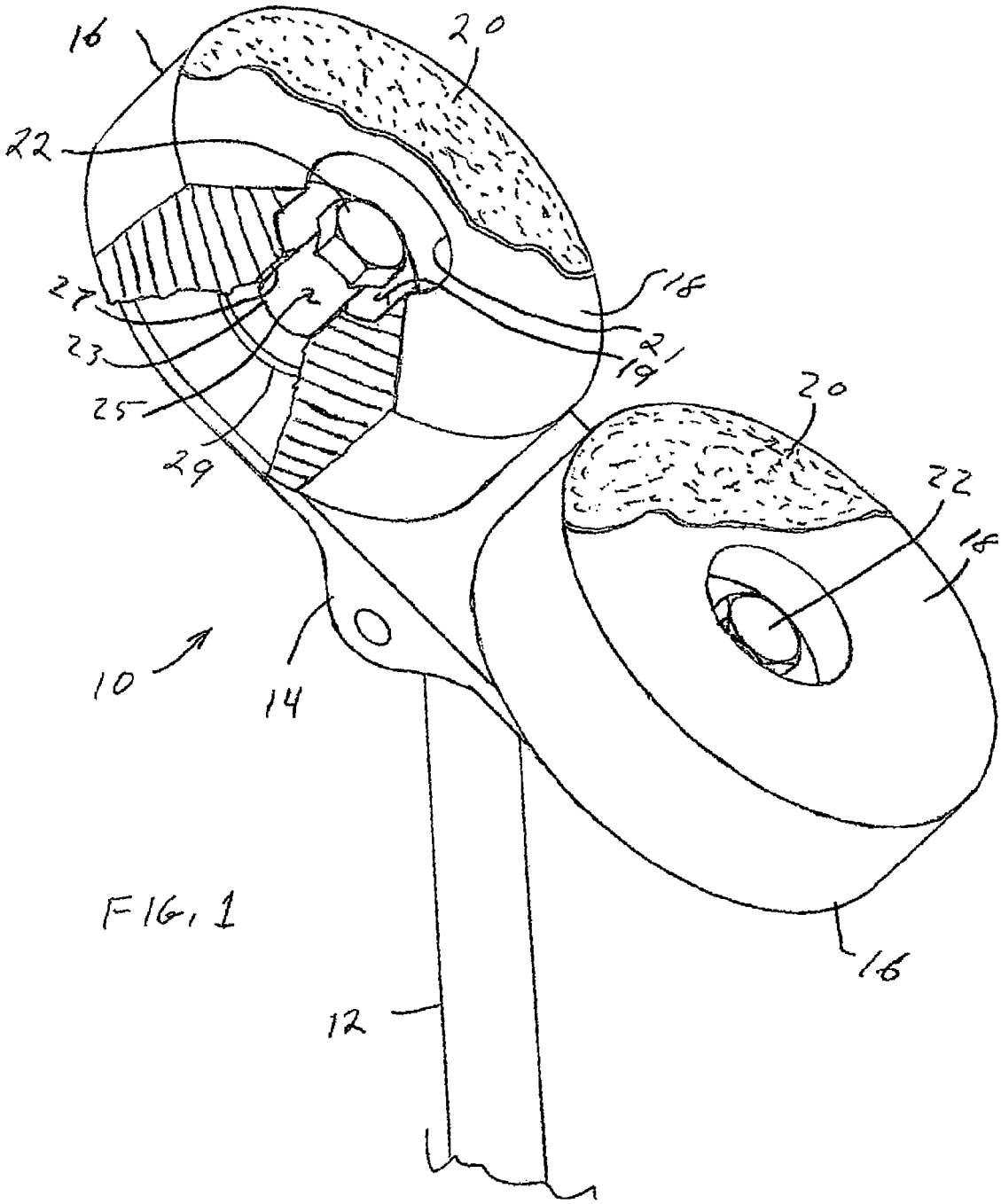
FIG. 1 is a view of my new corner sanding tool as seen from a bottom side view thereof.
Figures 1A, 1B:
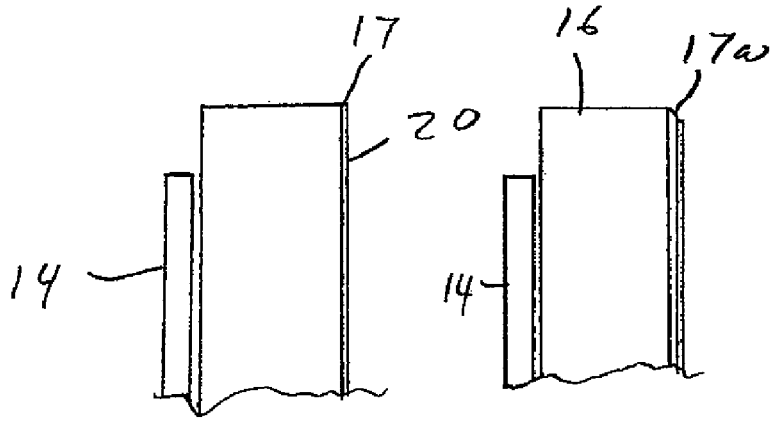
FIG. 1*a* is a partial view showing one possible wheel or disk configuration of the present invention.
FIG. 1*b* is another partial view of another possible wheel or disk configuration of the present invention.
Figure 2:
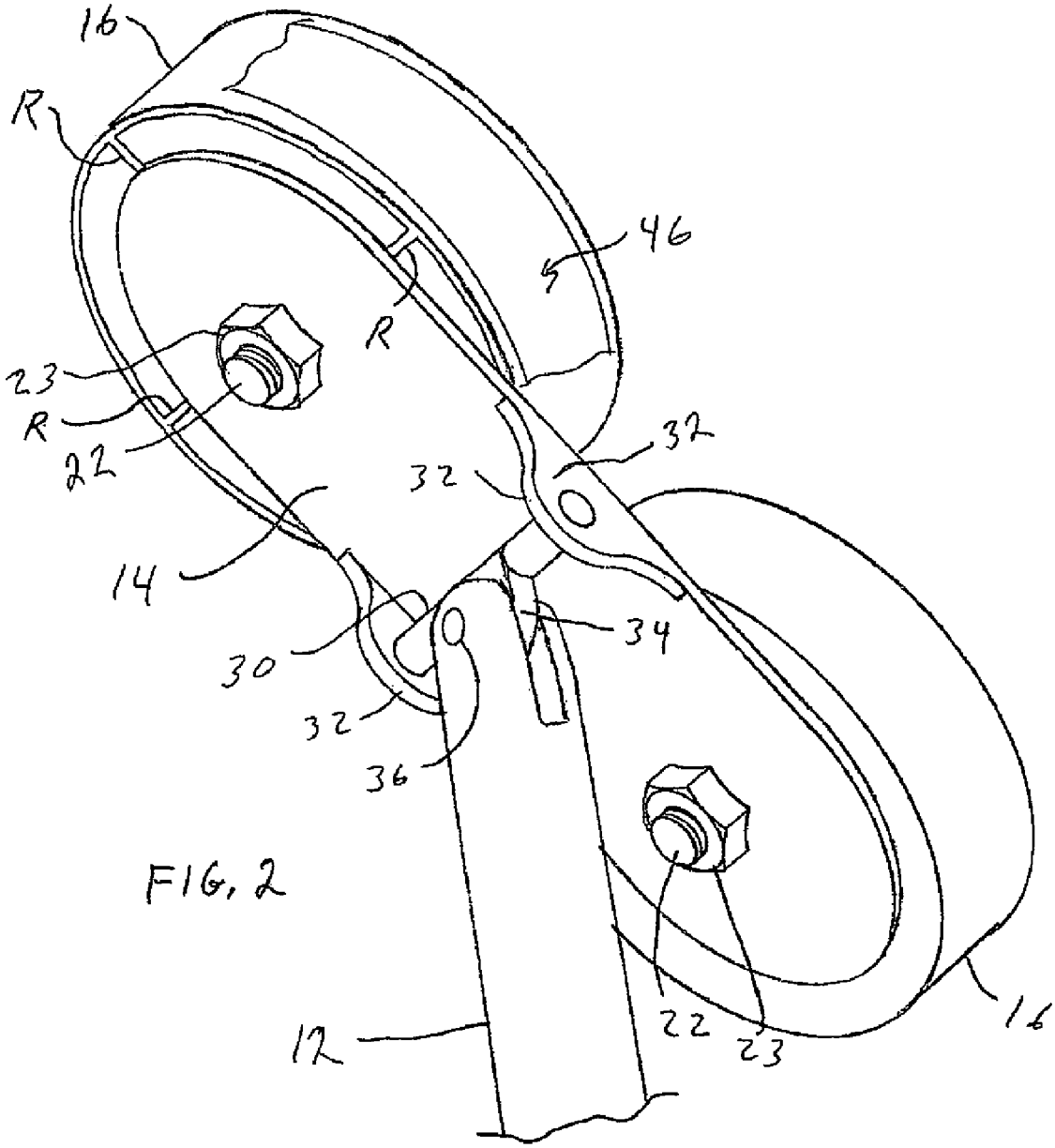
FIG. 2 is a view of my new corner sanding tool as seen from a top side view thereof.

As seen in FIG. 1, my new corner sanding tool 10 is constructed having a swivel handle 12, as will be shown and described in the following, handle 12 being connected to a mounting plate 14, plate 14 also denoted as a support means. Plate 14 supports at least one, and preferably two, circular, relatively thick sanding wheels or sanding disk holders 16, also denoted as sanding disk holder means, that may be on the order of anywhere from about 0.25" to 1" or more thick, about 4" to 5" in diameter and each having a flat outer face surface 18 configured to removably hold sanding disks 20 (shown partially broken away). While a relatively thick sanding disk holder is shown, it should be apparent that all that is required to implement my invention with respect to the sanding disk holders is to provide a flat outer face and relatively thick edges. As shown in FIG. 2 for the upper sanding disk holder, center regions of the disk holders may be hollow, with a thickened central region for supporting an axle about which the holder rotates, or the interior of my disk holders may be of a radial ribbed construction, as shown by ribs R (FIG. 2), to provide strength. As shown by the cut-away portion of a sanding disk holder in FIG. 1, the holders may also be of a solid construction. Disks 20 may be of any suitable sanding medium, such as sandpaper or a sponge-backed sandpaper, and may extend over a central opening 21 in disk holder 16, or be provided with an opening corresponding to opening 21. As shown in FIG. 1*a*, disk holders 16 may have a square edge 17 so that a sanding disk 20 extends directly up to edge 17 in order to sand the drywall mud all the way into the corner, or as shown in FIG. 1*b* edges of holders 16 may be provided with a small bevel 17 on the order of perhaps 1/16 of an inch or so and at a 30 degree or 45 degree angle, so that sanding disks 20 do not quite extend to the edge of holders 16. This is advantageous in that where a sandpaper disk is not perfectly centered on the flat face of the holder, the edge of the sandpaper disk will not groove or gouge the adjacent wall. Of course, where the corner of the holder is 90 degrees, as shown in FIG. 1*a*, care must be taken to closely center the sandpaper disk thereon. Surfaces 18 may have mounted thereto one portion of hook-and-loop tape, for receiving sanding disks 20 backed with the other portion of hook-and-loop tape, or be configured smooth so as to accept sanding disks backed by a removable adhesive such that the sanding disk may be attached and removed from the sanding disk holders 16. Advantageously, a single attachment member, such as a bolt 22, also designated as a rotational support means, is attached to plate 14 and rotatably supports wheels 16 so that they may freely turn while sanding a corner, as will be further explained. Bolts 22 may be shoulder bolts provided with a shoulder 23 that abuts flush against plate 14, with an upwardly extending, smooth portion 25 serving as an axle shaft for rotatably supporting holders 16. A spacer 29 (FIG. 1), which may be a washer, may be positioned about the axle shaft 25 so as to space sanding disk holders 16 away from mounting plate 14, as shown in FIGS. 1*a* and 1*b*. Alternately, a central portion of the sanding disk holder that is supported by the axle may be made slightly longer than the width of the holder in order to space the holder away from mounting plate 14.

The heads of bolts 22 are recessed within opening 21, and loosely bear against a floor 19 of opening 21. A thrust washer (not shown) may be disposed between the inner side of the head of bolt 22 and floor 19 so as to distribute loads during rotation of holder 16. Here, each opening 27 in holders 16 may be configured as a bushing, such as a bushing of metal or high density plastic. In other embodiments, opening 27 may simply be constructed of the same material as sanding disk holder 16. In other embodiments, a large rivet may be used to permanently attach drywall disk holder 16 to plate 14, with a head thereof recessed as shown in FIG. 1. Thus, sanding wheels or sanding disk holders 16 are each particularly mounted for rotation in load-bearing relation on mounting plate 14. While two sanding disk holders are shown, it is apparent that only one sanding disk holder 16 need be mounted to a plate 14 to implement the instant invention. Likewise, more sanding disk holders, such as three or more, may also be mounted to a single plate 14.

Referring now to FIG. 2, an opposite side of plate 14 is shown. In this view, it is seen that bolts 22 extend through plate 14, and are rigidly mounted as by nuts 23 against the back side of plate 14. Alternately, plate 14 may be provided with threads (not shown) for accepting bolts 22 in a tightened and secured relation and where needed, washers (not shown) may additionally be used on the opposite side of plate 14 for locking bolts 22 in tightened and secured relation on plate 14. Self-locking nuts may also be used in conjunction with a shoulder bolt. Handle 12 is attached by a swivel connection including a rotatably supported axle shaft 30 supported on each side of plate 14 by lugs or bosses 32, with handle 12 rotatably supported on a lug 34 at a pivot point 36. With this construction, plate 14 and wheels or disks 16 may be maintained in a flat relation against one wall of a corner joint as a drywall technician moves the apparatus up and down along a vertical corner joint, or back and forth for a ceiling joint, by swivel handle 12.

Figure 3:
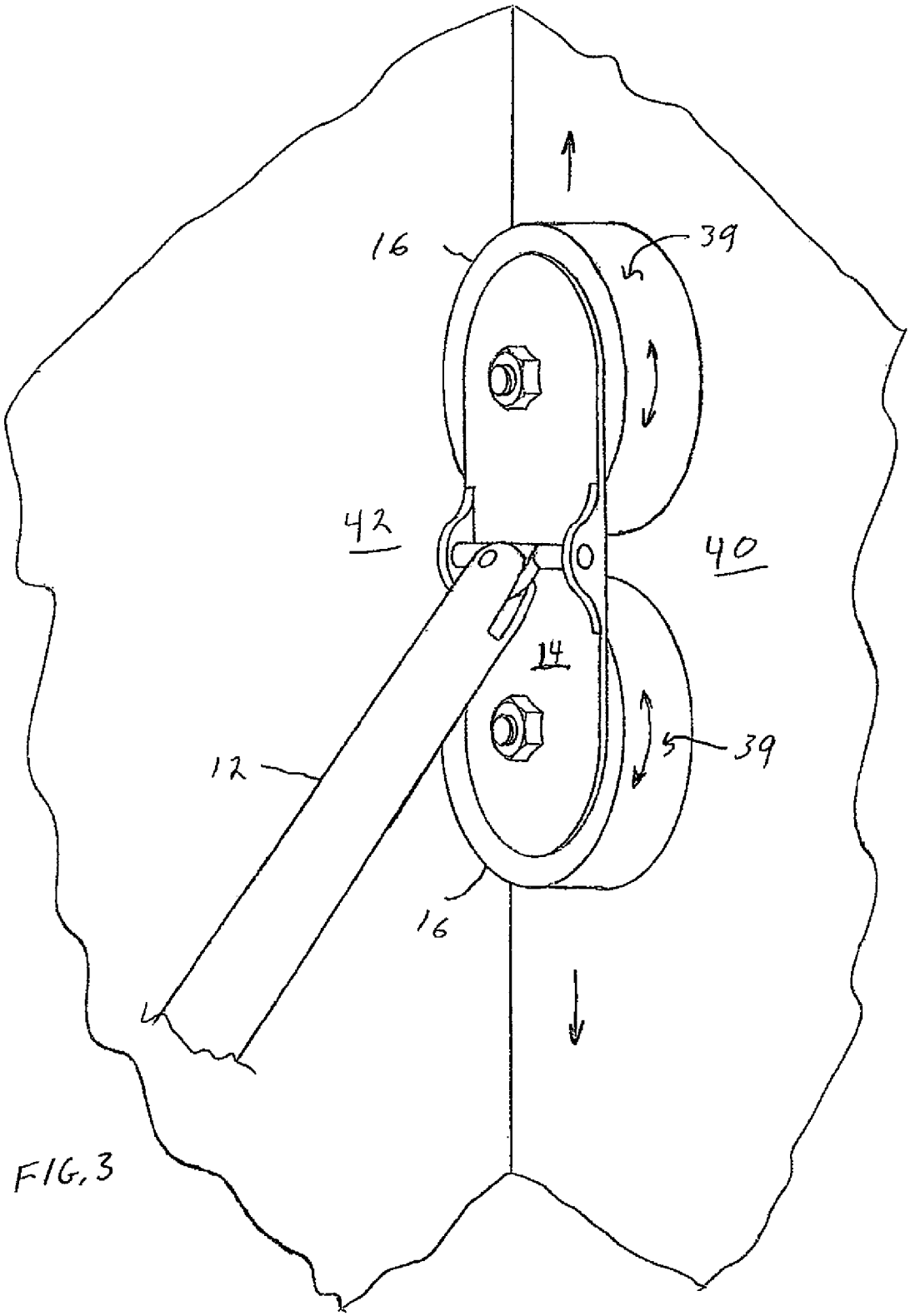
FIG. 3 is a view of my new corner sanding tool as it is used to sand drywall mud in a corner.

FIG. 3 illustrates operation of my new drywall corner sander. Here, all that is required is for a drywall technician to hold handle 12 and move the sanding surfaces of the sanding medium against one wall 40 of a mudded drywall corner joint. Unobvoiously, edges 39 of wheels or holders 16 are constructed for and intended to bear against the adjacent wall 42, causing holders 16 to rotate (shown by arrows) and impart a rotary sanding action against wall 40 that is more efficient and removes excess drywall mud faster than simply scrubbing sandpaper along wall 40. In fact, it has been demonstrated that my new sanding tool cuts sanding time of corners by more than half over the corner sanding devices of the prior art because of the rotary motion of holders 16. Further, damage to the adjacent wall 42 is eliminated due to width of edges of holders 16, which distribute the rolling load over an area sufficiently wide so as to prevent damage to the adjacent wall. In addition, it has been found that drywall joints greater than 90 degrees and up to about 120 degrees or so may be efficiently sanded using my new drywall sanding tool. Here, a small peripheral portion of an edge 39 of holder 16 that contacts the adjacent wall has sufficient frictional capability to rotate holders 16. In other embodiments, interchangeable sanding medium holders may be constructed with beveled edges to accommodate drywall joints other than 90 degrees, with 120 degree joints perhaps being the most common non-90 degree joint.

For facilitating rotary motion of holder 16, it is important that edges 39 of wheels or holders 16 be of a frictional character sufficient to frictionally engage wall 42 in order to overcome the friction developed by sanding the adjacent wall. Accordingly, a thin strip of frictional material 46 (partially shown in FIG. 2), such as rubber or other frictional material, may be positioned around or bonded to edges 39 of holders 16. In other embodiments, such frictional material may be molded into edges 39 of holders 16, and particularly peripherally along a region of the holder edge that would contact the aforementioned 120 degree drywall joint. With this construction, the tool may be rapidly rubbed up and down (or across) a corner joint with the sanding faces bearing against a wall 40 and edges 39 bearing against an adjacent wall 42. This generates rapid rotation of disk holders 16 analogous to rotation of a power tool, causing wall 40 to be sanded with just a few strokes. The tool is then turned so that the sanding faces bear against wall 42, with frictional edges 39 bearing against sanded wall 40. The tool is again moved up and down the length of the corner a few times, sanding the corner of wall 42.

It should be obvious to those skilled in the arts that many variations of my new drywall sanding tool may be implemented. As noted, the sanding disk holders 16 may be made somewhat wider or thinner, and the holders themselves may be of larger or smaller diameter. Importantly, the width of the edges of the holders should be sufficiently wide so as to not damage drywall mud of the adjacent wall and of a sufficiently frictional character so as to cause rotation of the holder against the sanding friction of the wall the sanded. In addition, while two holders 16 are shown attached to a plate 14, one or more holders, such as three or four, may be mounted to a single plate.

Having thus described my invention and the manner of its use, it should be apparent that incidental changes may be made thereto that fairly fall within the scope of the following appended claims, wherein I claim:

1. A drywall sanding tool for sanding drywall mud of drywall corner joints, said drywall sanding tool comprising:

an elongated mounting plate, at least two circular sanding disc holders rotatably mounted to one side of said mounting plate, said circular sanding disk holders each having a flat face and a relatively thick edge, a sanding disk removably attachable to a face of each circular sanding disk holder of said circular sanding disk holders, said relatively thick edge of each of said circular sanding disk holders configured for engagement with a wall adjacent to a wall of said drywall corner joint being sanded, for causing rotation of said circular sanding disk holders as they are moved along said drywall corner joint, developing a rotary sanding motion against said drywall corner joint being sanded, a handle mounted for swiveling operation attached to an opposite side of said plate.

2. A drywall sanding tool for sanding drywall mud of drywall corner joints as set forth in claim 1 wherein said relatively thick edge is of a frictional character.

3. A drywall sanding tool as set forth in claim 1 wherein said sanding disk is removably attached to said flat face of said circular sanding disk holder by adhesive.

4. A drywall sanding tool as set forth in claim 1 wherein said sanding disk is removably attached to said flat face of said circular sanding disk holder by hook-and-loop tape.

5. A drywall sanding tool as set forth in claim 1 wherein an outside corner of each said relatively thick edge sanding disk holder is a 90 degree corner so that a respective said sanding disk extends to an edge of said circular sanding disk holder.

6. A drywall sanding tool as set forth in claim 1 wherein an outside corner of each said circular sanding disk holder is provided with a small beveled region, with a respective said sanding disk terminating at an inside edge of said beveled region so that said sanding disk does not extend to said edge of said circular sanding disk holder.

7. A drywall sanding tool as set forth in claim 1 wherein said relatively thick edge of said at least two circular sanding disk holders are from about ¼ inch to about 1 inch in thickness.

8. A drywall sanding tool as set forth in claim 1 wherein said at least two circular sanding disk holders are from between about 3 inches to about 5 inches in diameter.

9. A drywall sanding tool for sanding drywall mud of a drywall corner joint, said drywall sanding tool comprising:

a mounting plate, at least two rotational support means connected to one side of said mounting plate, at least two drywall sanding disk support means rotationally engaging respective ones of said at least two rotational support means, each said sanding disk support means for removably holding a disk of drywall sanding medium, edges of said at least two drywall sanding disk support means configured for frictionally engaging a wall adjacent a wall of said drywall corner joint being sanded, facilitating rotation of said drywall sanding disk support means as said sanding disk support means are moved along said drywall corner joint, a handle mounted for swiveling operation attached to an opposite side of said mounting plate, for moving said sanding tool along said drywall corner joint.

10. A drywall sanding tool as set forth in claim 9 wherein said at least two drywall sanding disk support means each further comprises:

a circular holder having a flat face against which said sanding medium is removably affixed, an edge of relatively wide character peripherially around said flat face for frictionally engaging said wall adjacent said wall of said drywall corner joint being sanded.

11. A drywall sanding tool as set forth in claim 10 wherein said edge of relatively wide character is configured including a frictional material, for frictionally engaging said wall adjacent said wall of said drywall corner joint being sanded.

12. A drywall sanding tool as set forth in claim 10 wherein an edge between said flat face and said edge of relatively wide character is a 90 degree edge.

13. A drywall tool as set forth in claim 10 wherein an edge between said flat face and said edge of relatively wide character is a beveled edge.

14. A drywall sanding tool as set forth in claim 10 wherein said at least two rotational support means each further comprises a shoulder bolt mounted to said mounting plate and having a smooth portion serving as an axle shaft.

* * * * *